US005822969A

United States Patent [19]

Špindler et al.

[11] Patent Number: 5,822,969

[45] Date of Patent: Oct. 20, 1998

[54] DEVICE FOR DELIVERING WOUND BOBBINS FROM A TEXTILE MACHINE

[75] Inventors: Zdeněk Špindler, B. Něcové; Vojtěch Novotný, Dukelská, both of Czech Rep.

[73] Assignee: Rieter Elitex a.s., Usti nad Orlici, Czech Rep.

[21] Appl. No.: 730,085

[22] Filed: Oct. 15, 1996

[30] Foreign Application Priority Data

Oct. 16, 1995 [CZ] Czech Rep. ..... 2693-95

[51] Int. Cl.[6] ..... D01H 9/10

[52] U.S. Cl. ..... 57/281; 57/90; 242/35.5 A

[58] Field of Search ..... 57/281, 90; 242/35.5 A

[56] References Cited

U.S. PATENT DOCUMENTS

| | | | |
|---|---|---|---|
| 4,076,132 | 2/1978 | Thompson et al. | 242/35.5 A X |
| 4,144,961 | 3/1979 | Kasahara et al. | 242/35.5 A X |
| 4,615,493 | 10/1986 | Teranishi et al. | 242/35.5 A X |
| 4,657,194 | 4/1987 | Wey et al. | 242/35.5 A |
| 4,690,342 | 9/1987 | Langen | 242/35.5 A |
| 4,723,885 | 2/1988 | Grube et al. | 242/35.5 A X |
| 5,092,452 | 3/1992 | Nakayama | 242/35.5 A X |
| 5,168,696 | 12/1992 | Stahlecker | 57/281 |
| 5,247,788 | 9/1993 | Bertrams et al. | 57/281 |

*Primary Examiner*—William Stryjewski

*Attorney, Agent, or Firm*—Ostrolenk, Faber, Gerb & Soffen, LLP

[57] ABSTRACT

A device for delivering wound bobbins from a textile machine, comprising a main conveyor of wound bobbins, the conveyor having an end, an ancillary belt conveyor which receives wound bobbins from the end of the main conveyor and conveys them in a conveying direction; and a multi-story row container at one or both lateral sides of the ancillary conveyor. The height of the ancillary conveyor is adjustable to the height of each row in the row container. An adjustment device, such as one that tilts the row of bobbins on the ancillary conveyor, causes the bobbins to move from the ancillary conveyor to a row of the row conveyor in a direction perpendicular to the motion direction of the belt of the ancillary conveyor.

13 Claims, 6 Drawing Sheets

DEVICE FOR DELIVERING WOUND BOBBINS FROM A TEXTILE MACHINE

BACKGROUND OF THE INVENTION

The present invention relates to a device for delivering wound bobbins from a textile machine. In particular, it transfers the bobbins from an open end spinning machine including a main conveyor holding bobbins arranged along the length of the textile machine and transfers the bobbins to an ancillary conveyor of wound bobbins located at the end of the main conveyor.

BACKGROUND OF THE INVENTION

DE OS 42 22 723 A1 discloses a device for delivering full cross-wound, cylindrical bobbins or cones from a textile machine. The device comprises a main conveyor of bobbins arranged along the length of the textile machine. A stationary ancillary conveyor for wound bobbins is placed at the ends of the main conveyor to receive bobbins therefrom. An ancillary transfer conveyor is adjustably mounted over the main conveyor. The front part of the ancillary conveyor takes over full cross-wound bobbins from the stationary ancillary conveyor and transports them in the same direction. The rear part of the ancillary transfer conveyor is arched to change the delivery direction of the full cross-wound bobbins. The adjustability of the whole ancillary transfer conveyor enables the end of the rear part of the ancillary transfer conveyor to be related to or placed at one of the intermediate containers onto which the full cross-wound bobbins are delivered from the stationary ancillary conveyor. The intermediate containers consist of inter-container conveyors. The ends of the intercontainer conveyors lead to a delivery device with a delivery conveyor.

The above described delivery device is considerably complicated, both in design and in operation, particularly in the section where the bobbins are delivered from the stationary ancillary conveyor to the inter-container conveyors. Faults in bobbin delivery occur, especially during motion of the ancillary transfer conveyor which is opposite the direction of the motion of the stationary ancillary conveyor because delivery of a possibly large number of bobbins can surpass the capacity of the conveyors.

Another known device for delivering wound bobbins from a textile machine, as described in U.S. Pat. No. 5,168,696, contains an ancillary conveyor of full bobbins. That ancillary conveyor communicates with the end of the main conveyor of the machine and receives bobbins coming from the main conveyor and deposits them in the ancillary conveyor in a row each next to each other. An intermediate storing device for a plurality of bobbin rows is parallel with the ancillary conveyor. The storing device consists of an elevator comprising a plurality of means for receiving a bobbin row from the ancillary conveyor. Motion of the elevator brings its receiving device toward the delivery conveyor which is also arranged parallel to the intermediate storing device. There is a take out device for taking bobbins from a bobbin row of the receiving device and for setting them on the delivery conveyor that then transports them for further processing, for instance for dyeing them, etc. The take out device is situated between the delivery conveyor and the receiving device of the elevator.

The bobbin rows are placed into the receiving devices of the elevator by tilting the ancillary conveyor.

Such a device is complicated, imposes heavy demands both during its production and on its adjustment, and is usable only in fully automated plants or operations where the intervening devices are interconnected with each other, and where the bobbins are led from the machine where they have been produced to a subsequent machine to be processed. It would be too expensive and superfluous to use it in non-automated shops where it is sufficient to deposit the bobbins from the machine into pallets or similar storing means.

The deposit of the bobbins into the pallets is indispensable if the bobbins are to be transported for considerably long distances. But this appears to be superfluous in a non-automated shop, since it involves the relatively complicated further work of putting the bobbins into the pallets and later taking them out of the pallets.

SUMMARY OF THE INVENTION

Since it is often difficult, and sometimes even impossible, to achieve full automation in modernizing old plants, this invention has as its object to deliver full bobbins from a textile machine, and proposes a simple device intended to do away with the drawbacks of the above described art.

The above goal of the invention is achieved with a device for delivering full bobbins from a textile machine, in particular from an open-end spinning machine. The principle of the invention is for the ancillary conveyor to be adjustable in height so as to communicate, on the one hand, with multi-story-like row containers for the bobbins which containers are arranged at one or both lateral sides of the ancillary conveyor. Further, a device is provided for taking over the bobbin rows from the ancillary conveyor in the direction perpendicular to the direction of the motion of the ancillary conveyor and for placing these bobbin rows into the story-like row container located to the one or other side.

Putting the bobbin rows into the story-like row container first on the one and then on the other side of the ancillary conveyor provides a simple and economical method of delivering full bobbins from a textile machine, which is particularly useful for textile shops that are not fully automated.

The displacing device for taking the bobbin rows from the ancillary conveyor to one or the other of its side preferably comprises tilting means for tilting the ancillary conveyor. This has the advantage of being easily applied to the ancillary conveyor which is adjustable in height since the tilting means can be a part of the ancillary conveyor.

Preferably, the multi-story-like row container for full bobbins comprises a plurality of full bobbin containers arranged one over the other in a stack of several stories or levels in height. The entire story-like row container can be movable, and the individual row containers can be removably arranged in the story-like row container.

This design of the story-like row container permits it to be used not only in textile shops without full automation, but also in shops with automated bobbin delivery from the textile machine, in which the bobbins were produced, to the subsequent machine intended to process the bobbins.

Each row container for bobbins within the multi-story container can preferably comprise two parallel bars that are separated by a distance less than the smallest diameter of the full bobbin to be deposited. Such a row container of bobbins is simple. But it has a drawback of possible damage to the bobbin windings caused by the parallel bars. There is also a risk of a wound bobbin falling between the parallel bars if its diameter is less than the expected smallest bobbin diameter.

The preceding dangers are eliminated in another embodiment of the row container which comprises two parallel bars that are mutually connected by a generally flat, but three dimensional formation. The dimension of the formation between the parallel bars is greater than the distance between these parallel bars. For example, the generally flat three dimensional formation curves downward between the parallel bars in the direction caused by the force of gravity.

For simplicity, the three dimensional formation is made of cloth.

The desired distance between the set of parallel bars supporting a formation is preferably greater than the largest diameter of the bobbin which will be deposited on them as the bobbin does not rest on the bars. Within the row container, the bobbin rests on the three dimensional surface longitudinally or transversely. The benefits of using the textile material cloth in the row container construction is that the rows of bobbins rest gently and firmly with no shifting of either of the bobbin rows. Using this construction, there is no risk of the bobbins falling off.

Other features and advantages of the present invention will become apparent from the following description of the invention which refers to the accompanying drawings.

BRIEF DESCRIPTION OF THE DRAWINGS

An embodiment of a device for delivery of full bobbins from a textile machine is shown in the accompanying drawings.

DESCRIPTION OF THE PREFERRED EMBODIMENT

Figure 1:
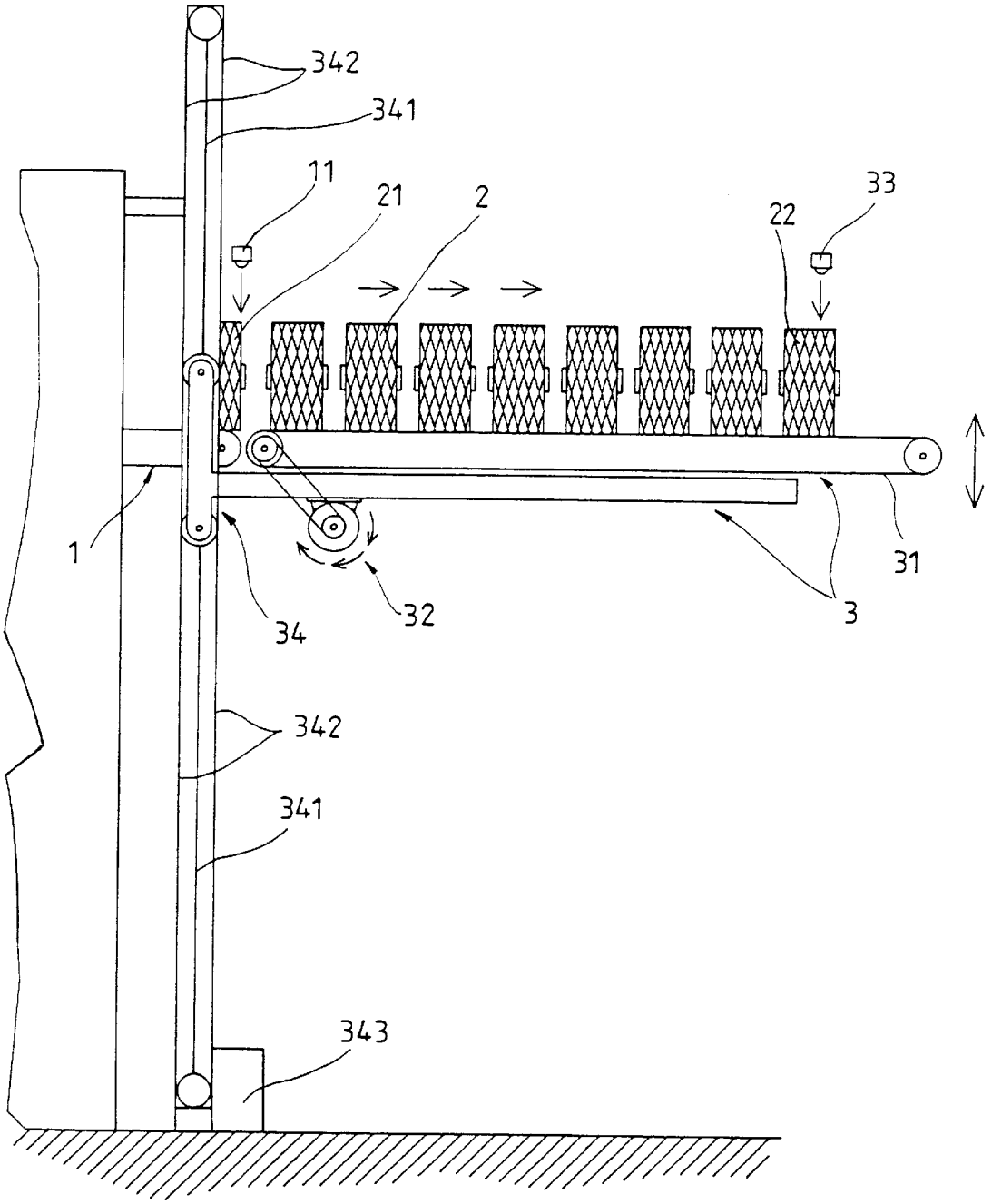
FIG. 1 shows a side view of the device at the outlet end section of the textile machine.

The device for delivering wound bobbins from a textile machine is explained in conjunction with an open-end spinning machine which comprises many operating stations situated side by side on each side of the machine. The main conveyor 1 of the machine conveys wound bobbins 2 arranged in the middle of the machine along the whole length of its operating stations. In the end section of the main conveyor 1 there is a sensor 11 for sensing the passage of the last bobbin 21 of the machine through the end section of the main conveyor 1.

An ancillary conveyor 3 which can be a belt conveyor, extends from the end of the main conveyor to the free end of the ancillary conveyor. The belt 31 of the conveyor 3 has raised edges and is coupled with a horizontal drive 32 which moves the upper run of the belt 31 away from the main conveyor 1 of the textile machine. A sensor 33 at the end section of the ancillary conveyor 3 detects the position of the last bobbin 22 in the row 2 on the ancillary conveyor 3. This sensor 33 is coupled with a control unit (not shown) in the machine.

Figure 2:
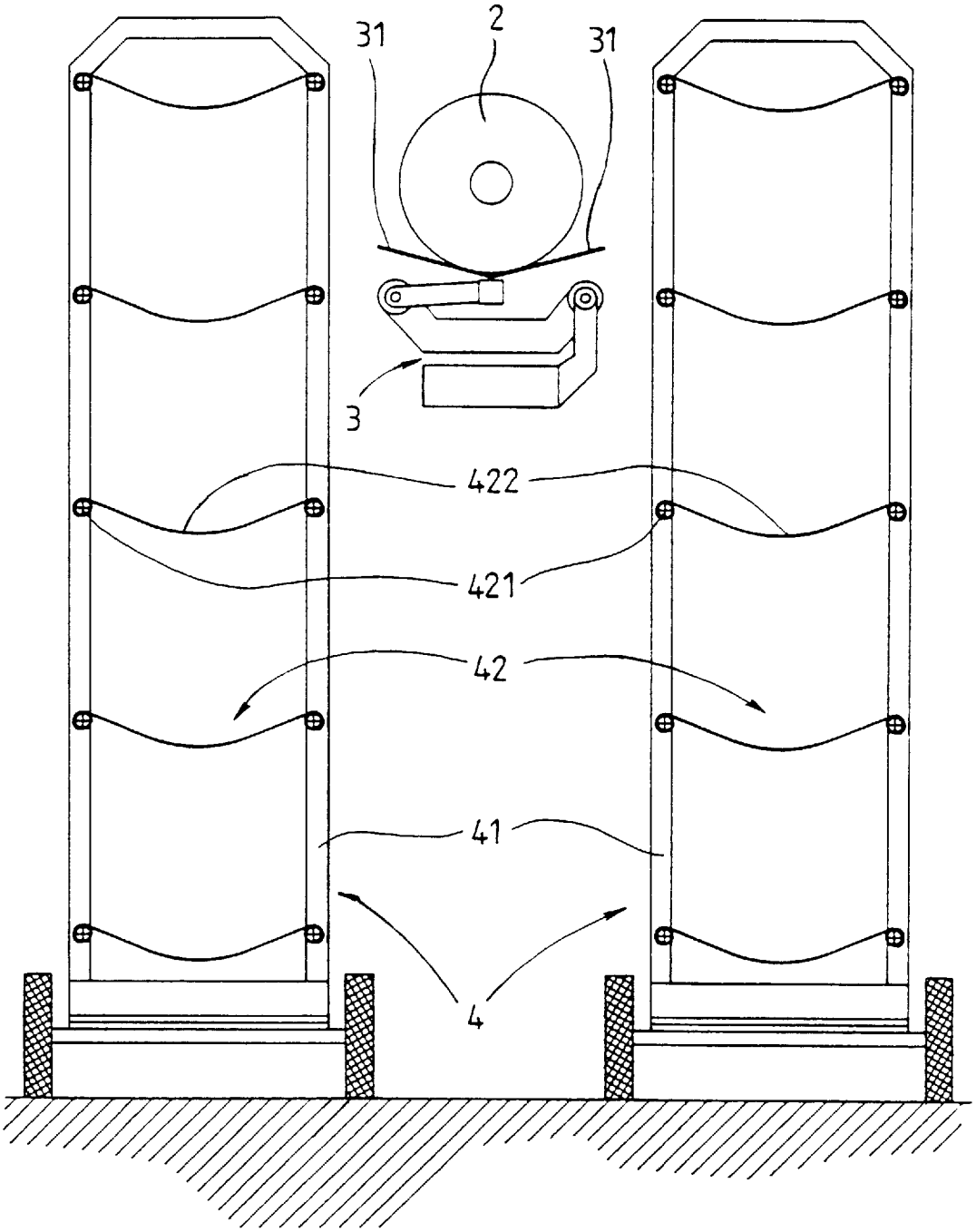
FIG. 2 shows a cross-section of the device in position for taking over the full (wound) bobbins from the textile machine.
Figure 3:
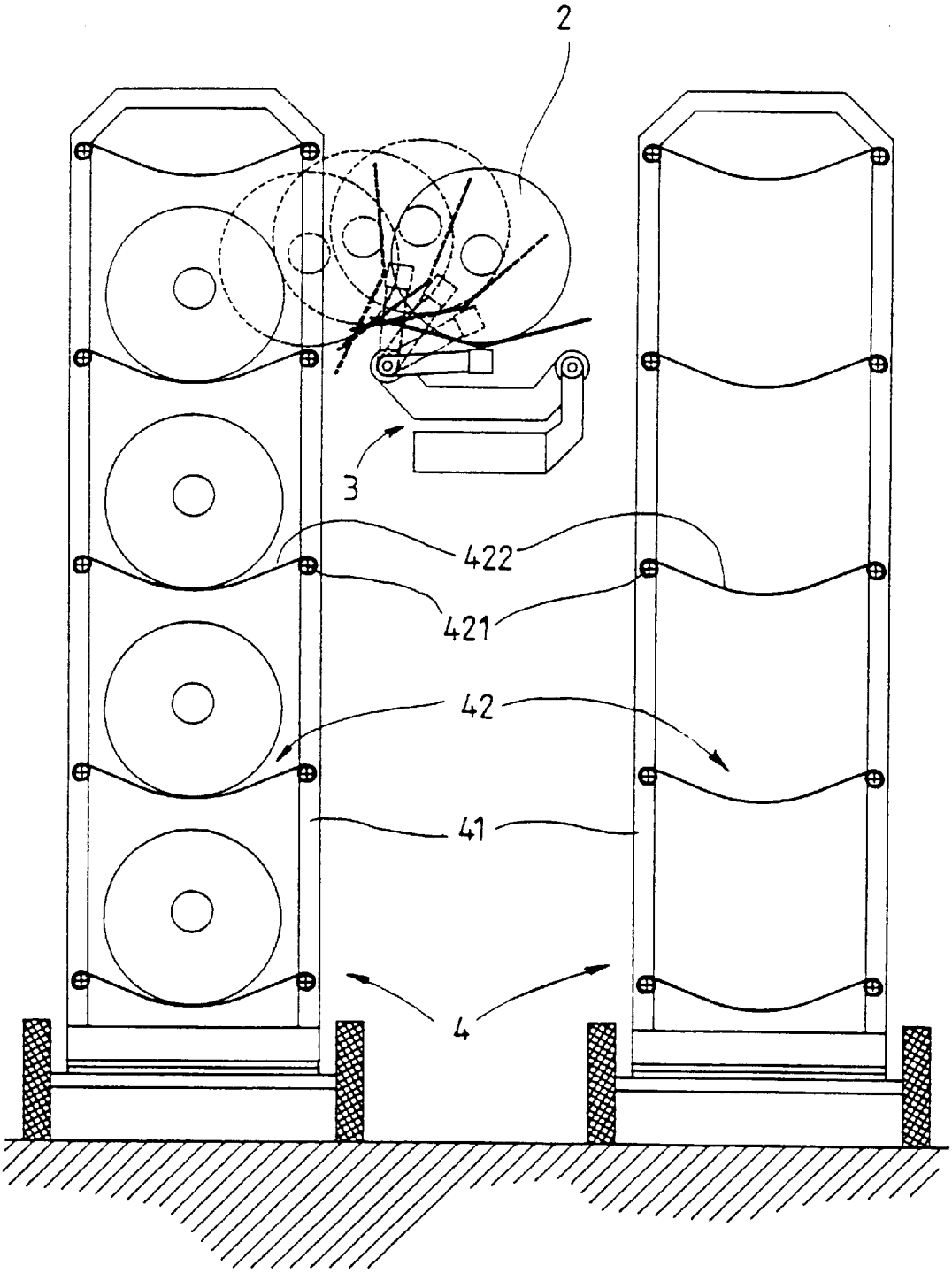
FIGS. 3, 4 and 5 show a cross-section of the device in the phase when the full bobbins are delivered from the ancillary conveyor to the story-like row container.
Figure 4:
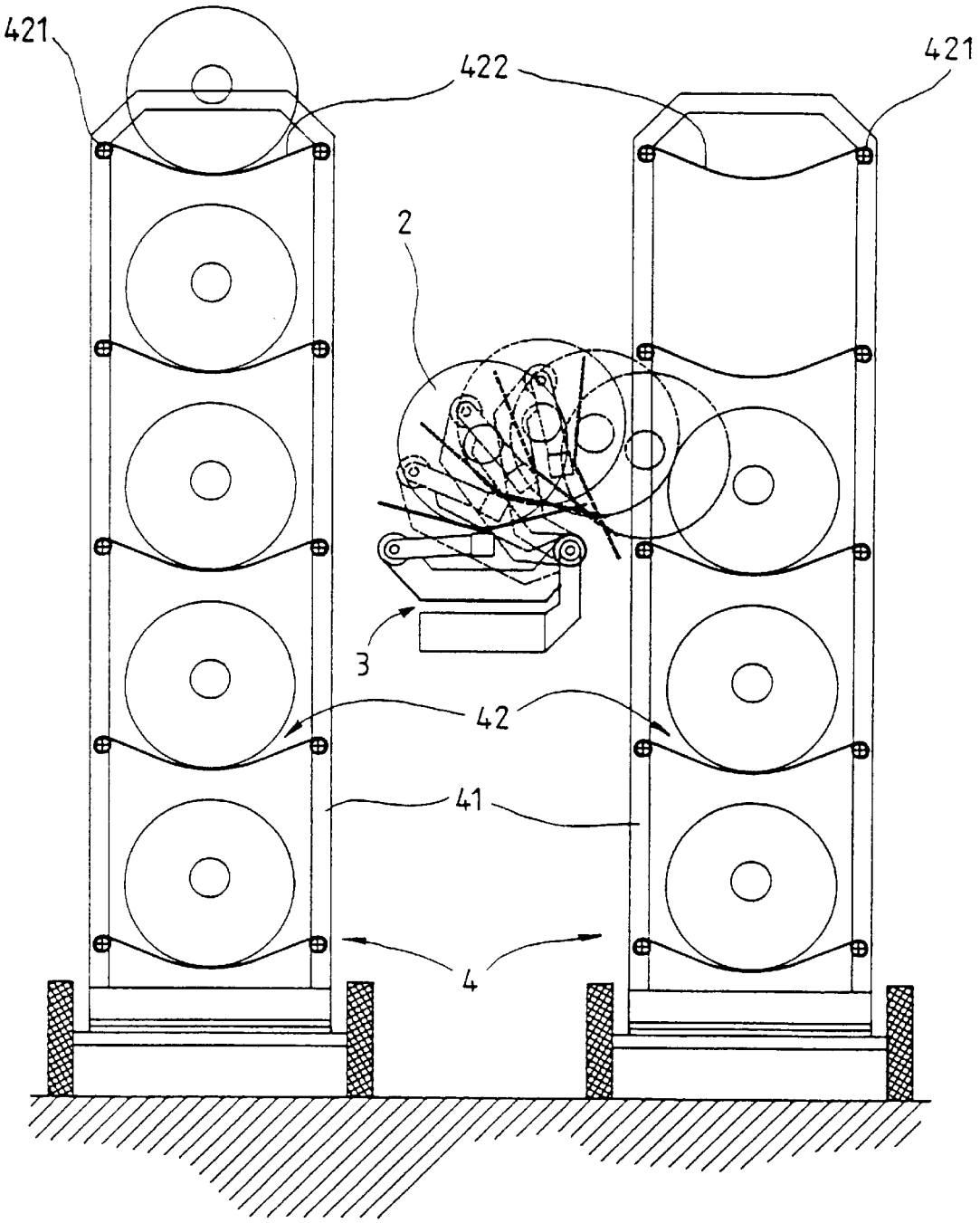

In the example of FIG. 2, the ancillary conveyor 3 is comprised of two belts 31 inclined toward each other, defining an angle. Their drive cylinders are coupled with horizontal drive 32. Optical sensor 33 is situated between the belts 31 in the rear part of the ancillary conveyor 3 for sensing the position of the last bobbin 22.

The height of the ancillary conveyor 3 is adjustable. In FIG. 1, it is mounted on a vertical adjustment mechanism 34 at the rear part of the machine. That comprises a vertical guide 341 on which the ancillary conveyor 3 is vertically slidingly mounted. It is connected with the two ends of a pair of the drive chains 342 which are coupled with a known vertical drive 343.

The vertical adjustment mechanism of the ancillary conveyor 3 can also be made in another way. For instance, the drive chains 342 can be replaced by racks and gear wheels, or by a motion screw and nut, or by a hydraulic or air cylinder.

At each of the two sides and parallel to the ancillary conveyor 3 are positioned respective story-like row containers 4.

The ancillary conveyor 3 is freely tiltable sideways and perpendicularly to the motion of the belt 31 of the ancillary conveyor 3. A device that is not shown which is also related to the ancillary conveyor may displace the rows of the bobbins 2 from the ancillary conveyor 3 to the included row containers 4 in the multiple story-like row container 4 for the bobbins 2.

The story-like row containers 4 for the bobbins 2 contain side walls 41 between which bobbin row containers 42 are mounted one above another. In the embodiment shown, the row containers 42 for the bobbins 2 are comprised of two parallel bars 421 between which is attached a slightly curved two dimensional formation 422 made of cloth. The width of the cloth between the parallel bars 421 is greater than the distance between the parallel bars 421. The distance between the bars is greater than the largest possible diameter of the full (wound) bobbin 2 which will be placed into the row container 42 so that the wound bobbin 2 rests securely on the cloth shelves 422 and between the parallel bars.

In other embodiments of the row container 42 for the bobbins 2, which are not shown, the cloth can be replaced by, a net, a mat, a system of parallel strips secured between the parallel bars 421 and transversely to them, a foil, or another flat three dimensional object such as a trough made of sheet or plastic material. The parallel bars 421 can be made to be a part of the trough or can be replaced by trough edges.

The cloth may even be eliminated. But in that case, the parallel bars are not further apart than the smallest expected diameter of a wound bobbin, so that the bobbin will not fall between the bars.

The (fully) wound bobbins 2 at the end of the machine are removed from each operating station and are placed on the main conveyor 1. They are then moved in the direction toward the ancillary conveyor. As each bobbin passes through the end section of the textile machine, each (fully) wound bobbin 2 is then the last bobbin 21 on the main conveyor 1. The sensor 11 monitors and signals the control devices of the machine both at the beginning and at the end of the passage of each bobbin 2.

The signal from the sensor 11 that indicates the passage of the leading edge of the last bobbin 21 sets the belt 31 of the ancillary conveyor 3 in motion. The signal from the sensor 11 that indicates the passage at the trailing end of the last bobbin 21 stops the motion of the belt 31 of the ancillary conveyor 3. Consequently, the belt 31 of the ancillary conveyor 3 is set in motion by the passage of each subsequent bobbin 2 through the end section of the main conveyor 1 of the textile machine. This stops when the last bobbin 22 of the row of (fully) wound bobbins 2, which rests on the belt 31 of the ancillary conveyor 3, passes the end sensor 33 of the ancillary conveyor 3. After that, the belt of the ancillary conveyor 3, which moves horizontally, stops because the row of the bobbins 2 on the belt 31 is complete.

The ancillary conveyor 3 then moves vertically until its belt 31 moves to line up with one of the empty row containers 42 of the story-like row container 4. Then another row of bobbins 2 is moved from the belt 31 of the ancillary conveyor 3 into the chosen to be filled row container 42. This could be accomplished by using the displacing device to move the rows of the bobbins 2 or by the tilting device for the ancillary conveyor 3.

After the belt 31 of the ancillary conveyor 3 has been emptied, the ancillary conveyor 3 moves back to its starting position, at which the belt 31 meets the upper surface of the main conveyor 1 of the machine because the main conveyor does not shift vertically.

After the next row of the bobbins 2 has been placed on the belt 31 of the ancillary conveyor 3, the ancillary conveyor 3 moves vertically to yet another empty row container 42 of the story-like row container 4 which is situated on the same side of the ancillary conveyor 3. This is done until all of its row containers 42 are filled with the rows of the bobbins 2. After that, the story-like row container 4 on the other side of the ancillary conveyor 3 is filled. During the filling of the second row container, the previously fully filled story-like row container 4 may be replaced by an empty one.

During the time when the ancillary conveyor 3 is not in its starting position aligned with the main conveyor 1 of the machine, the passage of the final bobbin 21 on the main conveyor 1 through the end sensor 11 of the main conveyor 1 will stop the main conveyor 1 until the return of the ancillary conveyor 3 to its starting position which is generally aligned with the main conveyor. At that point, both the belt 31 of the ancillary conveyor 3 and the main conveyor 1 are set in motion. The motion of the belt 31 of the ancillary conveyor 3 is stopped by a signal received from the end sensor 11 of the main conveyor 1 reporting the passage of the trailing end of the last bobbin 21.

Figure 5:
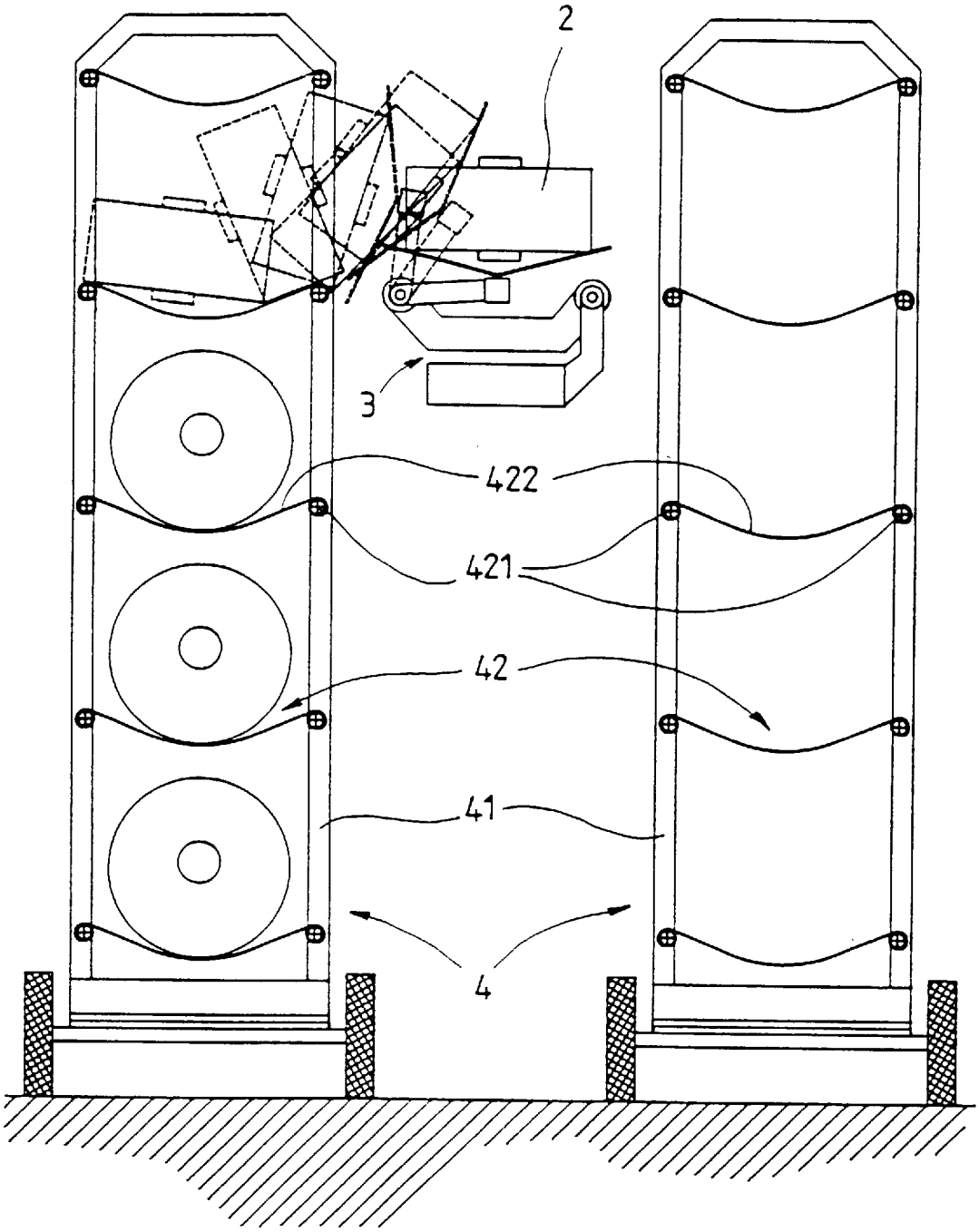
Figure 6:
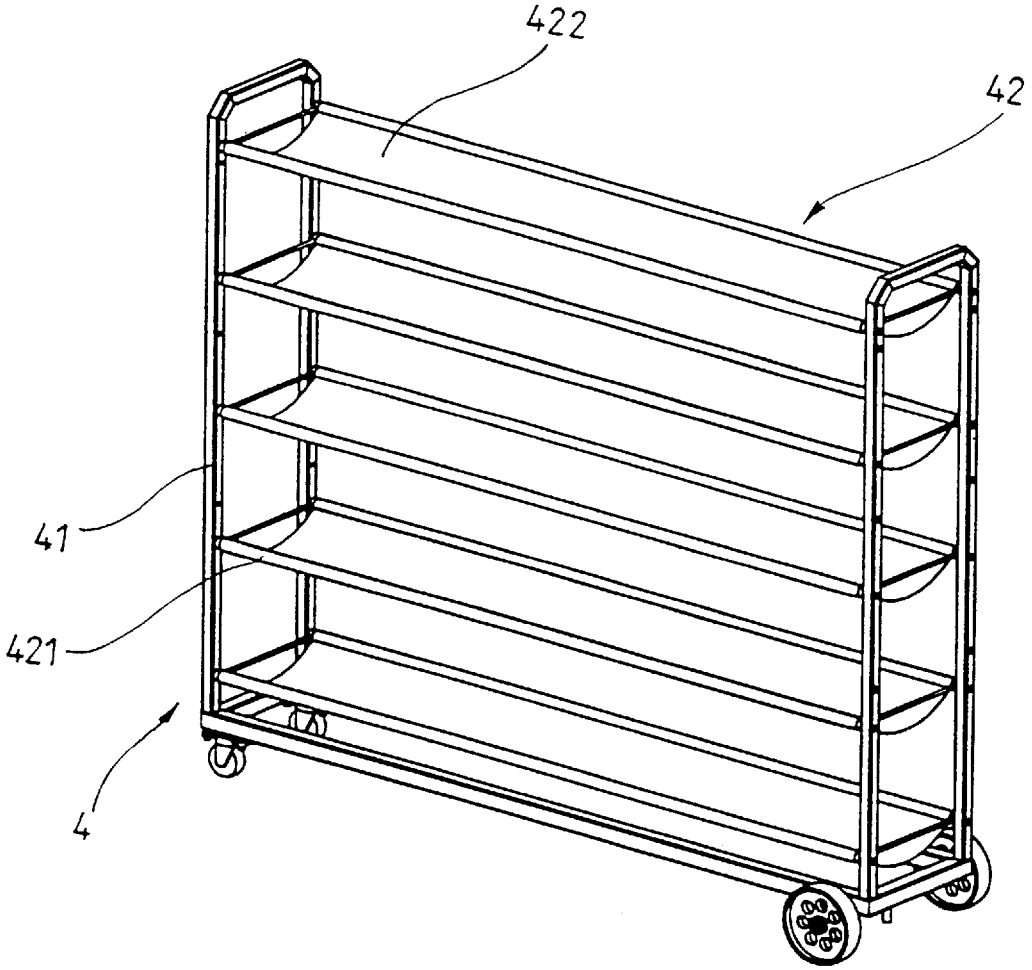
FIG. 6 shows an a perspective view of the story-like row container.

If a bobbin reversal or tilting, or a bobbin tipping over occurs on the main conveyor 1 or on the ancillary conveyor 3, the ancillary conveyor 3 operates in the same way as it would if that bobbin 2 were resting on the conveyor in its usual position. The movement of the bobbin 2 to its tilted position from the ancillary conveyor 3 to the story-like row container is shown in FIG. 5.

Although the present invention has been described in relation to a particular embodiment thereof, many other variations and modifications and other uses will become apparent to those skilled in the art. It is preferred, therefore, that the present invention be limited not by the specific disclosure herein, but only by the appended claims.

What is claimed is:

1. A device for delivering wound bobbins from a textile machine, comprising:

a main conveyor of wound bobbins, the main conveyor having a fixed height and an end toward which the main conveyor conveys the bobbins;

an ancillary conveyor of wound bobbins having a receiving end arranged for receiving wound bobbins from the main conveyor, and the ancillary conveyor including a movable conveyor for conveying wound bobbins along the ancillary conveyor away from the end of the main conveyor, the ancillary conveyor remaining horizontal along its length; the ancillary conveyor having lateral sides;

the ancillary conveyor being supported for adjustment of the height of the ancillary conveyor, the ancillary conveyor remaining horizontal;

a story like multi-row container arranged at least along one lateral side of the ancillary conveyor and including respective horizontal rows of bobbin row containers at various fixed heights on the story like container;

an adjustment device for displacing rows of bobbins from the ancillary conveyor in the direction laterally from the direction of motion of the ancillary conveyor to transfer wound bobbins to the bobbin row container of the story like container at the lateral side of the ancillary conveyor.

2. The device of claim 1, wherein the ancillary conveyor comprises a belt for receiving wound bobbins thereon and for moving the wound bobbins along the direction of the story like container, and the adjustment device operable for moving the bobbins in a direction perpendicular to the direction of belt motion.

3. The device of claim 1, further comprising a respective one of the story like row containers for bobbins arranged along each of the two lateral sides of the ancillary conveyor.

4. The device of claim 1, wherein the adjustment device is adapted for tilting the ancillary conveyor toward the lateral side at which the story like row container is located for causing the wound bobbins to transfer to the bobbin row container.

5. The device of claim 4, wherein the story like row of containers comprises a plurality of bobbin row containers arranged one above the other in a story like array.

6. The device of claim 1, wherein the story like row of containers comprises a plurality of bobbin row containers arranged one above the other in a story like array.

7. The device of claim 6, wherein the story like row of containers is movable with reference to the ancillary conveyor.

8. The device of claim 7, wherein individual bobbin row containers in the story like container are removably arranged in the story like container.

9. The device of claim 6, wherein individual bobbin row containers in the story like container are removably arranged in the story like container.

10. The device of claim 6, wherein each bobbin row container includes two parallel bars extending parallel to the conveying direction of the ancillary conveyor and being spaced a distance apart that is smaller than the smallest diameter of the wound bobbin to be deposited on that bobbin row container.

11. The device of claim 6, wherein each bobbin row container includes two parallel bars extending parallel to the conveying direction of the ancillary conveyor and the distance between the parallel bars being greater than the greatest diameter of the bobbin to be deposited on that bobbin row container;

each bobbin row container further comprising a generally flat two-dimensional formation extending between and supported by the parallel bars, which formation has a width greater than the distance between the parallel bars.

12. The device of claim 1, wherein each bobbin row container includes two parallel bars extending parallel to the conveying direction of the ancillary conveyor and being spaced a distance apart that is smaller than the smallest diameter of the wound bobbin to be deposited on that bobbin row container.

13. The device of claim 1, wherein each bobbin row container includes two parallel bars extending parallel to the conveying direction of the ancillary conveyor and the distance between the parallel bars being greater than the greatest diameter of the bobbin to be deposited on that bobbin row container;

each bobbin row container further comprising a generally flat two-dimensional formation extending between and supported by the parallel bars, which formation has a width greater than the distance between the parallel bars.

* * * * *